US007444781B2

(12) United States Patent
Luo

(10) Patent No.: US 7,444,781 B2
(45) Date of Patent: Nov. 4, 2008

(54) DEVICE FOR FIXING GLASSES ON A CURTAIN WALL OR ROOFING

(75) Inventor: Ken Yi Luo, Zhuhai (CN)

(73) Assignee: KGE Group Limited, Hong Kong (HK)

( * ) Notice: Subject to any disclaimer, the term of this patent is extended or adjusted under 35 U.S.C. 154(b) by 891 days.

(21) Appl. No.: 10/881,227

(22) Filed: Jun. 30, 2004

(65) Prior Publication Data

US 2005/0034400 A1 Feb. 17, 2005

(30) Foreign Application Priority Data

Jun. 30, 2003 (CN) ..... 03 2 47852 U

(51) Int. Cl.
*E04D 11/00* (2006.01)

(52) U.S. Cl. ..... 52/90.1; 52/204.593; 52/204.64; 52/204.65; 52/204.68; 52/208; 52/235

(58) Field of Classification Search ..... 52/90.1, 52/204.53, 204.593, 204.597, 204.64, 204.65, 52/204.68, 204.72, 208, 235
See application file for complete search history.

(56) References Cited

U.S. PATENT DOCUMENTS

| | | | | |
|---|---|---|---|---|
| 4,552,790 | A * | 11/1985 | Francis | 52/235 |
| 4,809,475 | A | 3/1989 | Emmer | |
| 2005/0241244 | A1 | 11/2005 | Luo | |

FOREIGN PATENT DOCUMENTS

| | | | |
|---|---|---|---|
| CH | 677690 | A5 | 6/1991 |
| DE | 39 05 743 | A1 | 8/1990 |
| EP | 0479751 | A1 | 4/1992 |
| EP | 0628672 | A1 | 12/1994 |
| EP | 0651105 | A2 | 5/1995 |
| NL | 1016724 | C | 5/2002 |
| WO | WO-95/13439 | | 5/1995 |

OTHER PUBLICATIONS

Search Report for EP 1 493 895 A3 completed May 24, 2005.

* cited by examiner

*Primary Examiner*—Richard E. Chilcot, Jr.
*Assistant Examiner*—Matt J Smith
(74) *Attorney, Agent, or Firm*—The Law Office of James E. Ruland, PLC

(57) ABSTRACT

A device for fixing glasses on a curtain wall or roofing, capable of being applied to a curtain wall and a covering layer adopting a rigid plate, especially a single-layer glass plate or a hollow laminated glass plate. The device comprises: a glass supporting beam having a special cross section, which has a base portion for rooting the fixing nails and two shoulders for supporting two adjacent glasses; a pressing bar inserted into the side seam of the hollow gum-sandwiched glass having a bar-like slot; and a pressing block fixed on the base portion having a pressing head extending into the bar-like slot. Furthermore, an adjustable block is disposed between the shoulders of the supporting beams and the glasses. The adjustable block has an upper surface for supporting glass and a bar-like hinge head, which is provided on the bottom surface and hinged on a bar-like hinge base provided on the shoulders of the supporting beams.

20 Claims, 9 Drawing Sheets

DEVICE FOR FIXING GLASSES ON A CURTAIN WALL OR ROOFING

FIELD OF THE INVENTION

The present invention relates to a device for fixing glasses on a curtain wall or roofing, of which the covering layer adopts a rigid plate, especially a single-layer glass plate or a hollow laminated glass plate.

BACKGROUND ART

Single-layer glass or hollow gum-sandwiched glass has been widely used as a decorative material for the roofing of some large-scale buildings. The main connecting bodies are glasses with many longitudinal and transverse beams which are used for supporting the glasses. The glasses may have one layer, two layers, or three layers, and they are fixedly mounted on a frame made up of longitudinal beams and transverse beams. Conventionally, there are two types of technological methods for fixedly mounting the glasses on the frame. Method one requires assembling, in a workshop, the glasses into unit-type framed glasses by utilizing an aluminum alloy and then fixedly mounting these units on the frame. The disadvantages of this method include complexity and excess consumption of decorative material. Method two requires applying an adhesive to the contacting surfaces between the glasses and the beams to make them adhere to each other, and then injecting a seal gum into the butt seam of two adjacent glasses. This fixing process has many deficiencies, such as wasted time, an extremely slow working speed, and high cost due to excess consumption of adhesive. Furthermore, during the mounting process, the spatial angles of the glasses can not be finely adjusted. This is a disadvantage because fine adjustment of the spatial angles may be necessary during the construction work, especially a roofing having a curved shape.

SUMMARY OF THE INVENTION

A main object of the present invention is to design a fixing device adaptable for fixing all kinds of glasses, as described above, on a curtain wall or roofing.

Another object of the present invention is to design a fixing device that is suitable for fixing glasses on a curved roofing and may be finely adjusted to compensate for the structural tolerances of the frame, which includes longitudinal beams and transverse beams.

Still another object of the present invention is to design a fixing device to enable quick construction of a glass curtain wall or roofing.

In order to achieve the objects described above, the present invention adopts the following technical solution. The beams constituting a frame for supporting the glasses have a special cross section, which has a base portion for rooting the fixing nails and shoulders for supporting two adjacent glasses. The base portion is higher than the two shoulders. Two adjacent glasses are placed on two surfaces formed by two shoulders of the beams. If laminated glasses are used, a side seam having a recess is formed between two layers of the glasses. Next, a pressing bar is engaged with the side seam. The pressing bar is wedged into the side seam of the hollow gum-sandwiched glass having a bar-like slot and a glass-pressing surface which is perpendicular to the surface on which the bar-like slot is provided. During assembly, the bar-like slot opens outward. Furthermore, a series of the pressing blocks are uniformly distributed along every side of the hollow glass. The pressing blocks fixed on the base portion of the supporting beam have pressing heads extending into the bar-like slots. In this manner, four sides of the pressing blocks can fix the hollow gum-sandwiched glass to the frame made up of the beams via the pressing bars. Using this device, construction work will be rapid and convenient. Furthermore, the glasses will be securely and reliably fixed. For a single-layer glass, the glass-pressing surface of the pressing bar directly presses on the glass surface.

If a curtain wall or roofing is shaped as a plane, the respective metal beams unavoidably include deformation. Also, an included angle will occur between the glass-supporting surface of each beam and the mounting surface. In order to eliminate the hidden danger caused by the included angle, the present invention offers an adjustable block disposed between the shoulders of the supporting beams and the glasses. The adjustable block has an upper surface for supporting glass and has a bar-like hinge head, which is disposed on the bottom surface and inserted into a bar-like hinge base on the shoulders of the supporting beams. The glass-supporting surface has two functions: firstly, in the plane of one hollow gum-sandwiched glass, it may make up for the unflatness of the metal frame caused by the manufacturing tolerances and the welding deformations; secondly, two adjacent glasses lying on two shoulders of the beam can be adjusted relative to each other and the included angle formed between the adjacent glasses is finely adjusted for the insufficiency or excess of the curvature caused by the frame. For purposes of improving the manufacturability and the sealing property during mounting, a double-faced adhesive strip and a sealing cushion may be pressed between the glass-supporting surface of the adjustable block and the glass.

To concurrently reduce the consumption of seal gum, decrease cost, and improve the quality of the seam on the roofing, the present invention comprises a series of hooking members fixed on the base portion of the supporting beam and precisely fixed in the seam between the adjacent glasses by fasteners. The hooking member hooks a pressing cap pressed in the butt seam between the adjacent glasses. Next, a sealing adhesive strip is pressed between the two sides of the pressing cap and the end surface of the glasses. Finally, seal gum is filled between the two sides of the pressing cap and the end surface of the glasses.

DETAILED DESCRIPTION

The present invention is made obvious by this description in combination with the drawings and the preferred embodiments described.

Figure 1:
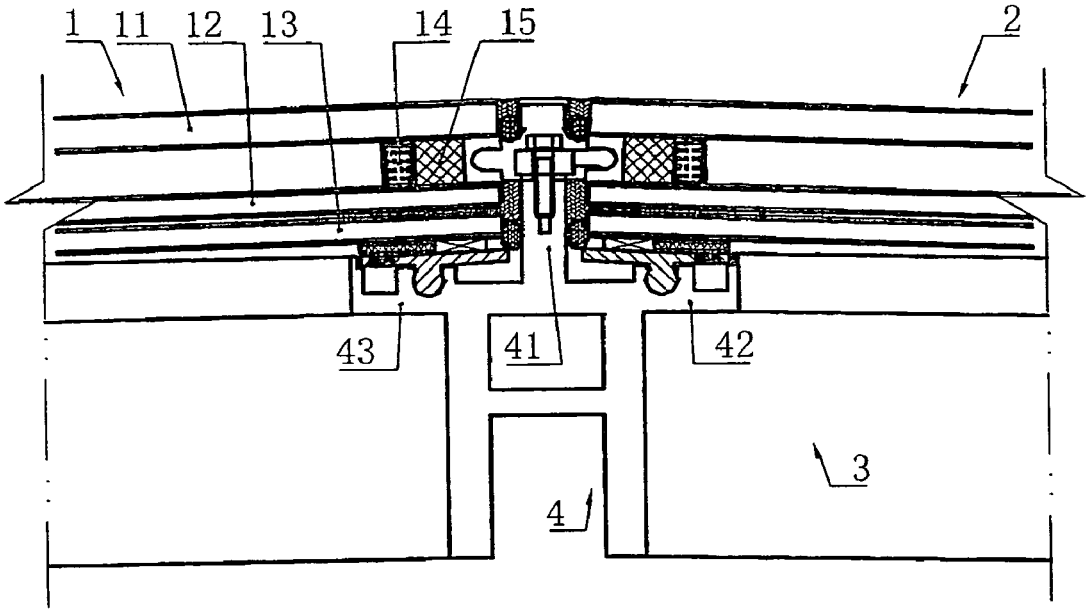
FIG. 1 is a cross-sectional view along one edge of the frame made up of beams.
Figure 4:
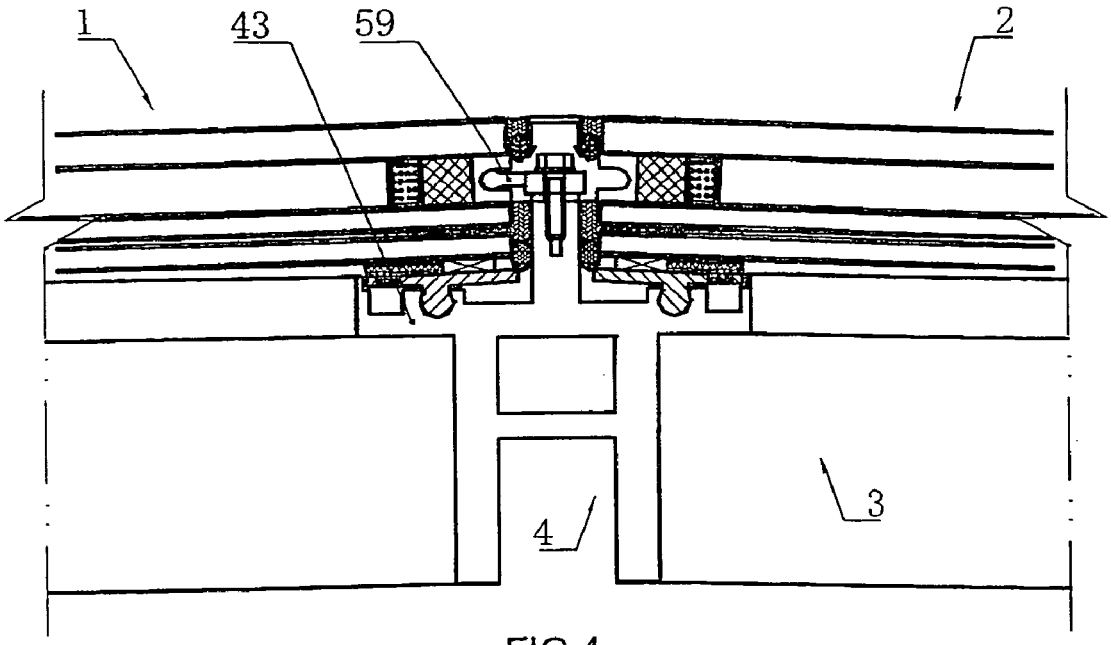
FIG. 4 is a cross-sectional view showing a pressing block adjacent to one edge of the frame made up of beams.

Referring to FIG. 1, a transverse beam 3 and a longitudinal beam 4, as shown, make up a frame for supporting the hollow glasses. One edge of the two adjacent hollow glasses 1 and 2, lap on a left shoulder 43 and a right shoulder 42 of the beam 4 respectively. Beams 3 and 4 include a metal section material having a cross-sectional shape as shown in FIG. 4, and a base portion between two shoulders. The hollow glass 1 is commercially available and includes three layers comprising the glasses 11, 12 and 13. Gum is sandwiched between glasses 12 and 13, while a molecular plug 15 is used as a spacer between glasses 11 and 12. In addition, a seal gum 14 is provided between glasses 11 and 12.

Figure 2:
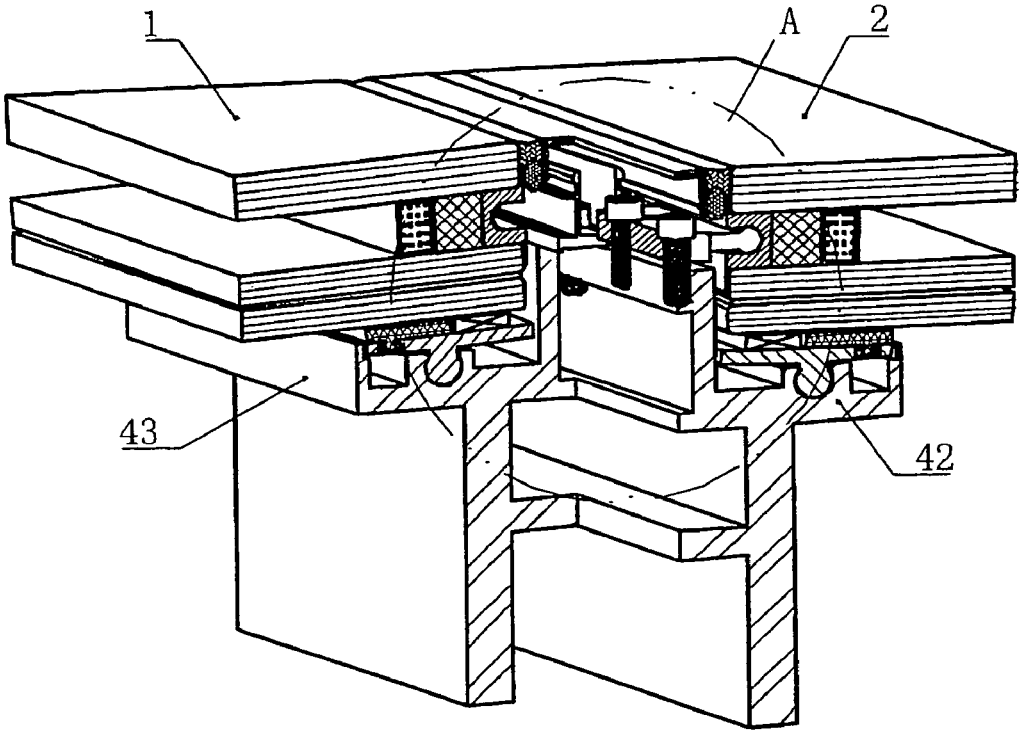
FIG. 2 is a perspective view of the fraction in FIG. 1.
Figure 3:
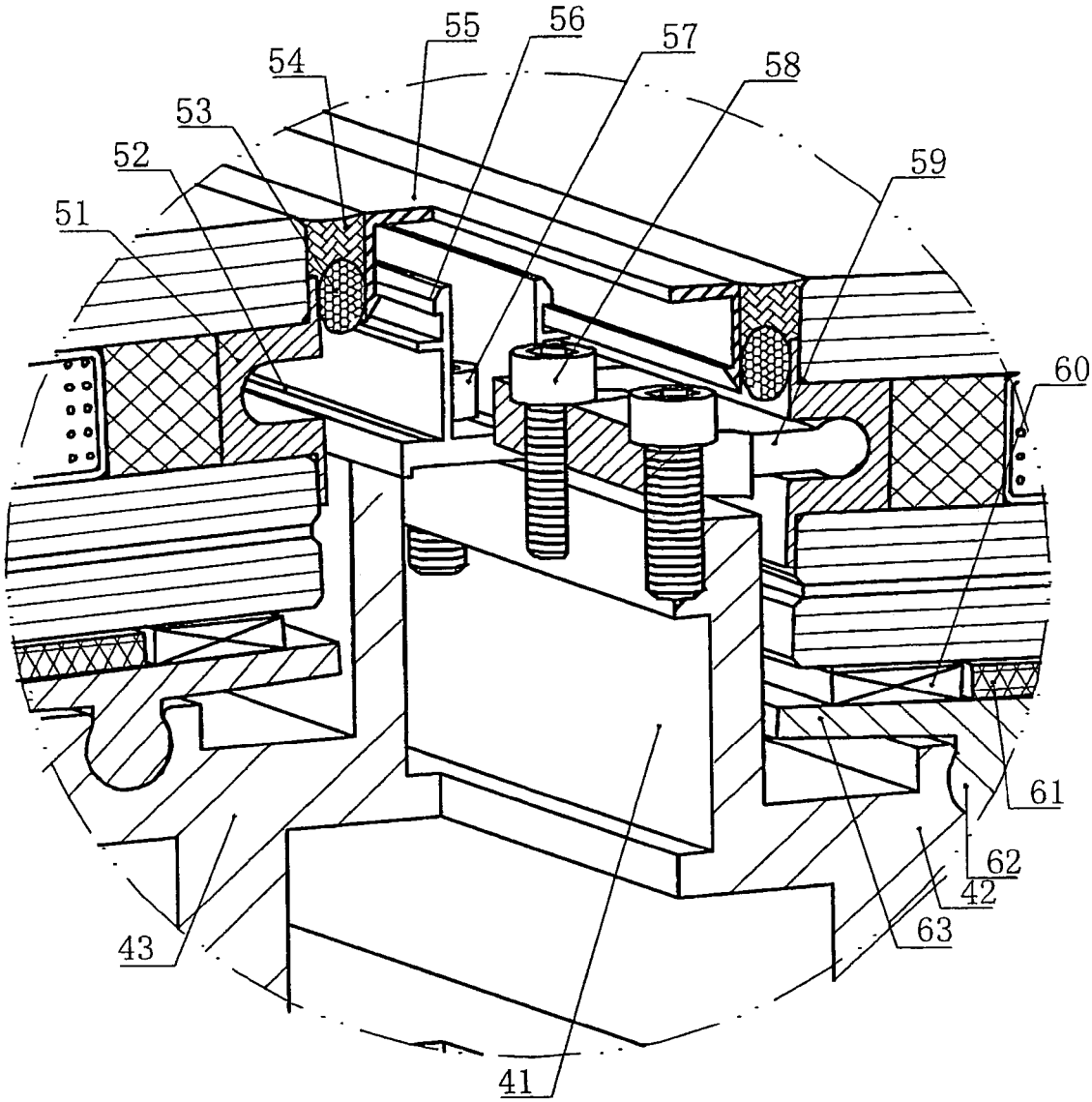
FIG. 3 is an enlarged view of section A in FIG. 2.

Referring to FIG. 2 and FIG. 3, hereafter, we will describe how to connect and fix the hollow gum-sandwiched glasses 1 and 2 with beam 4. A pressing bar 51 having a length as long as the edge of the glass is inserted into a recess provided at the edge of the hollow glass. Along the side length direction of the glass, there is a bar-like slot 52 that may contain the head portion of a pressing block 59. As shown, the hollow glass 2 on the right shoulder 42 is held down through the pressing bar 51 by the pressing block 59, which is fixed on the base portion 41 by using a pair of screws 58. A series of the pressing blocks 59 is uniformly distributed along the length of the beam 4. In the same manner, the hollow glass 1 on the left shoulder 43 and the four edges of the glasses are fixed on beam 4, enabling all glasses to be fixed. A bar-like hinge base is provided on each shoulder. An adjustable block 63 has a glass supporting surface and a bar-like hinge head 62, which is disposed at the bottom part of the adjustable block 63 and is rotationally inserted in the hinge base. Before a glass is placed on the frame, a double-faced adhesive 60 and a sealing cushion 61 are disposed between the glass supporting surface of the adjustable block 63 and the abutting surface of the glass. Furthermore, many hooking members 56 are discontinuously fixed on the base portion 41 by screws 57. A pressing cap 55 can hook the hooking members so as to substantially cover the butt seam between two adjacent glasses. The tiny gaps between the glasses and the cap 55 are sealed by a joint strip 53 and a seal gum 54.

Figure 5:
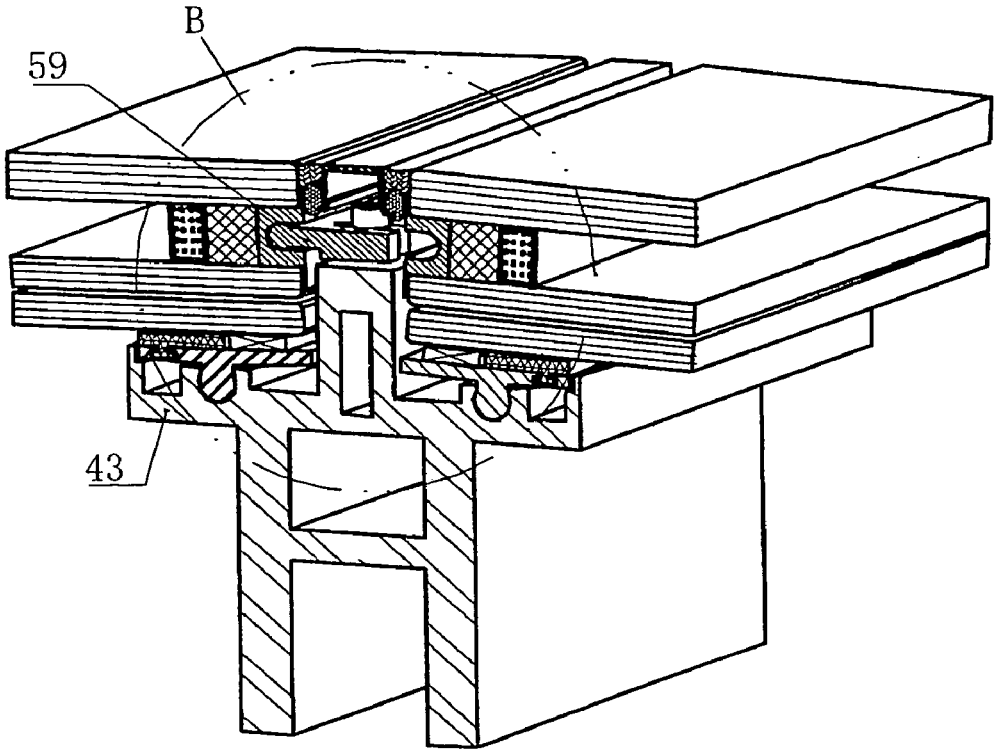
FIG. 5 is a perspective view of the fraction in FIG. 4.
Figure 6:
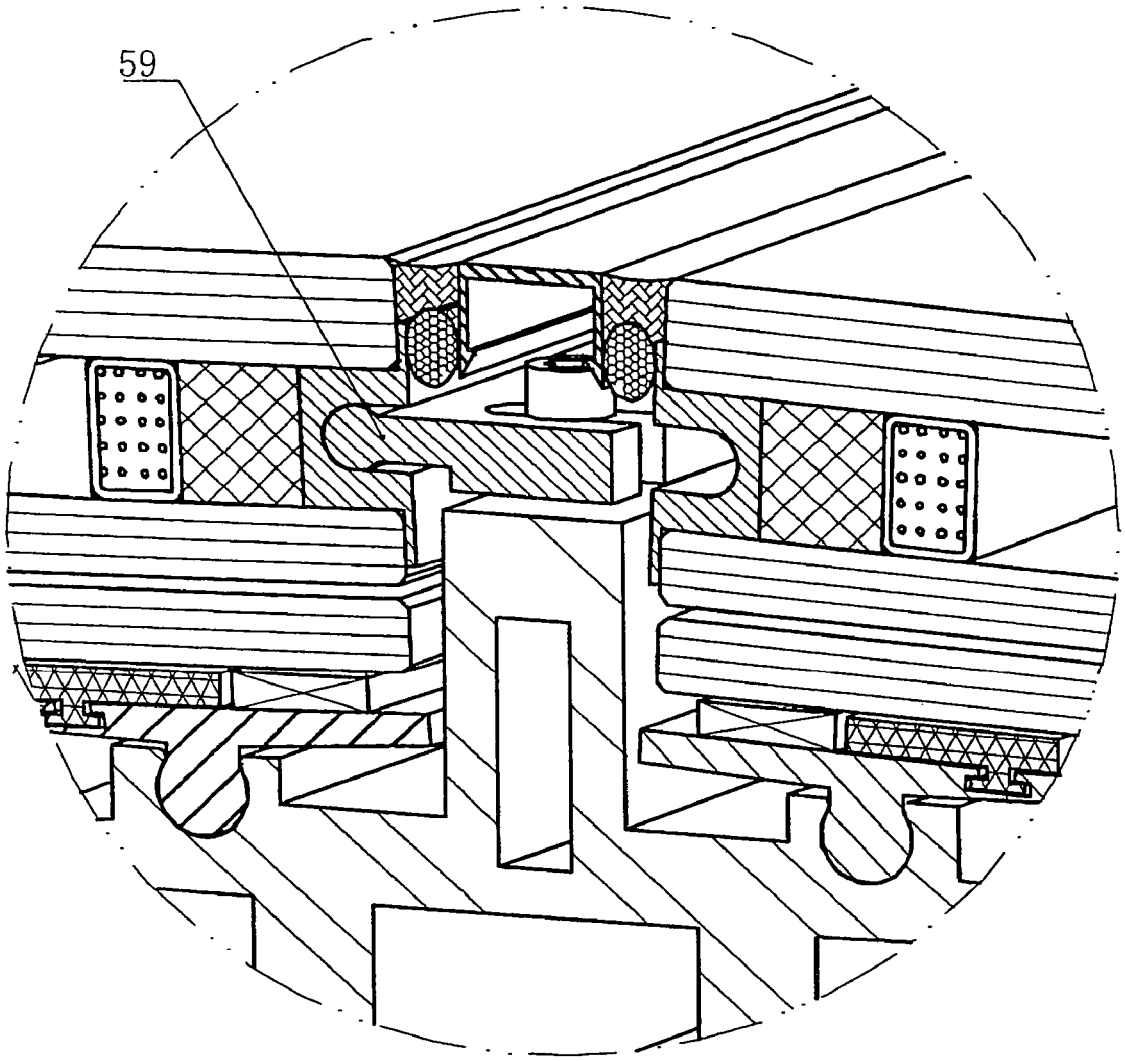
FIG. 6 is an enlarged view of section B in FIG. 5.

Referring to FIG. 4, FIG. 5 and FIG. 6, these drawings mainly show how glass 1 on left shoulder 43 is fixed by a single-side pressing block 59. Also, the single-side pressing blocks are uniformly distributed along the side length of the hollow glass, and the pressing blocks on the left shoulder are staggered relative to the ones on the right shoulder.

Figure 7:
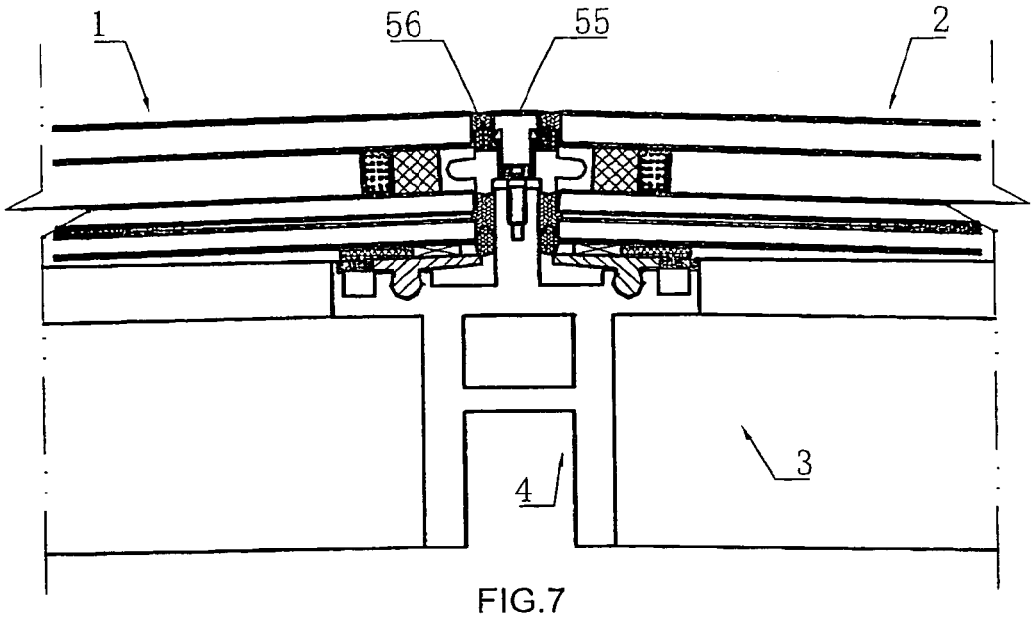
FIG. 7 is a cross-sectional view showing a hooking member adjacent to one edge of a frame made up of beams.
Figure 8:
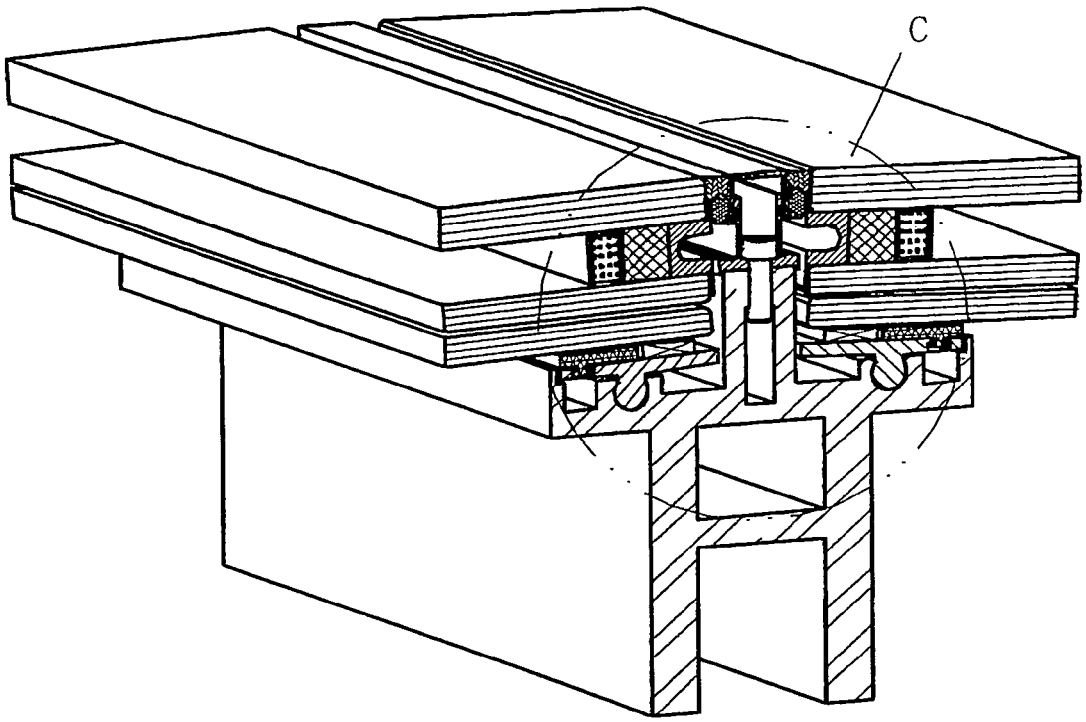
FIG. 8 is a perspective view of the fraction in FIG. 7.
Figure 9:
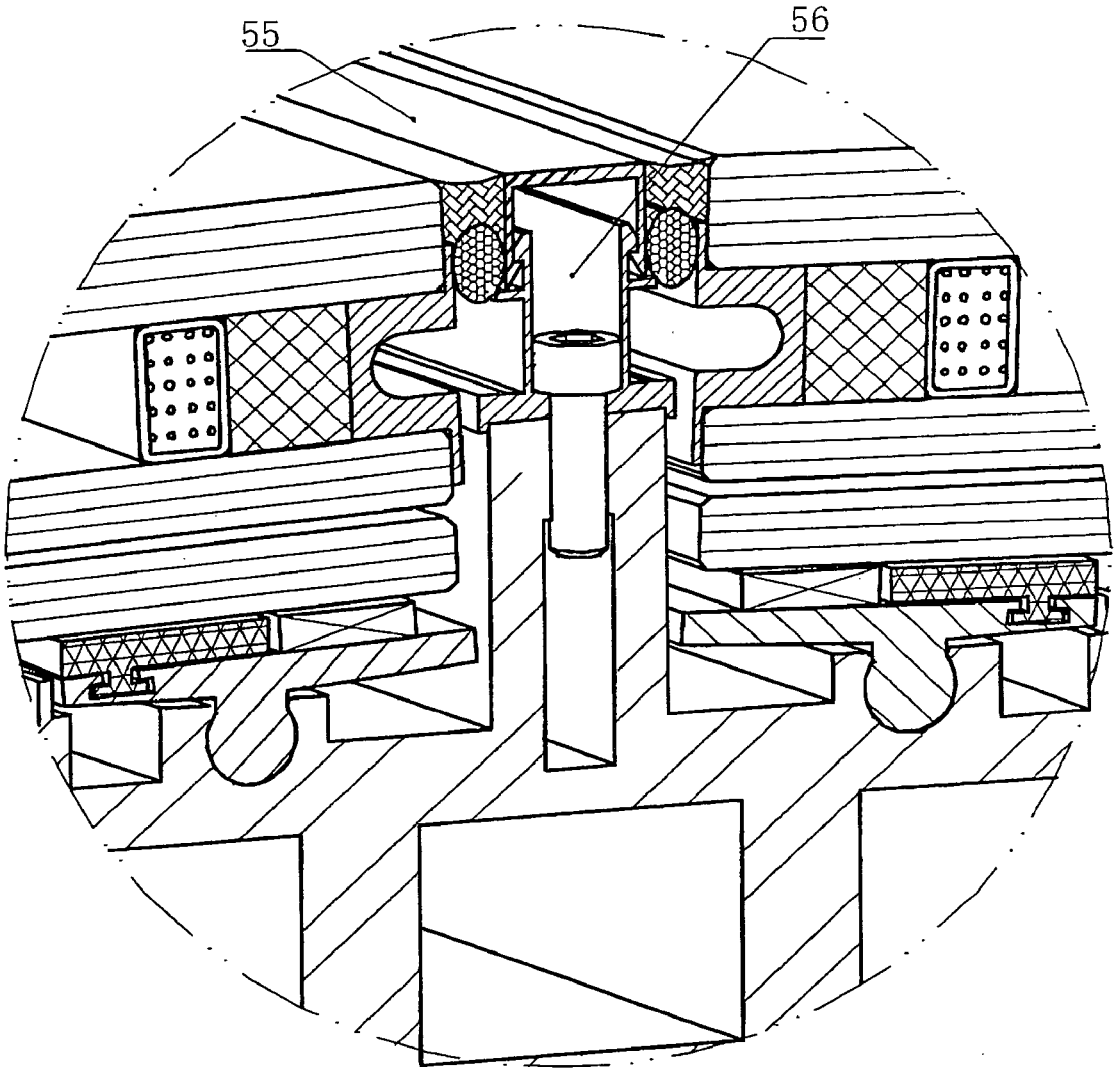
FIG. 9 is an enlarged view of section C in FIG. 8.

Referring to FIG. 7, FIG. 8 and FIG. 9, these drawings show how hooking member 56 hooks with the cap 55. The hooking member 56 is comprised of two elastic symmetrical wing panels. On the top part outside either wing panel of the hooking member 56, there is a hooking position formed by a rib and a backstop edge. The cap also has two symmetrical wing panels. Inside each wing panel of the cap 55, there is a hooking position formed by the backstop edge. The mating hooking positions on the hooking member 56 and the cap 55 hook together under pressure, as shown in each drawing.

Figure 10:
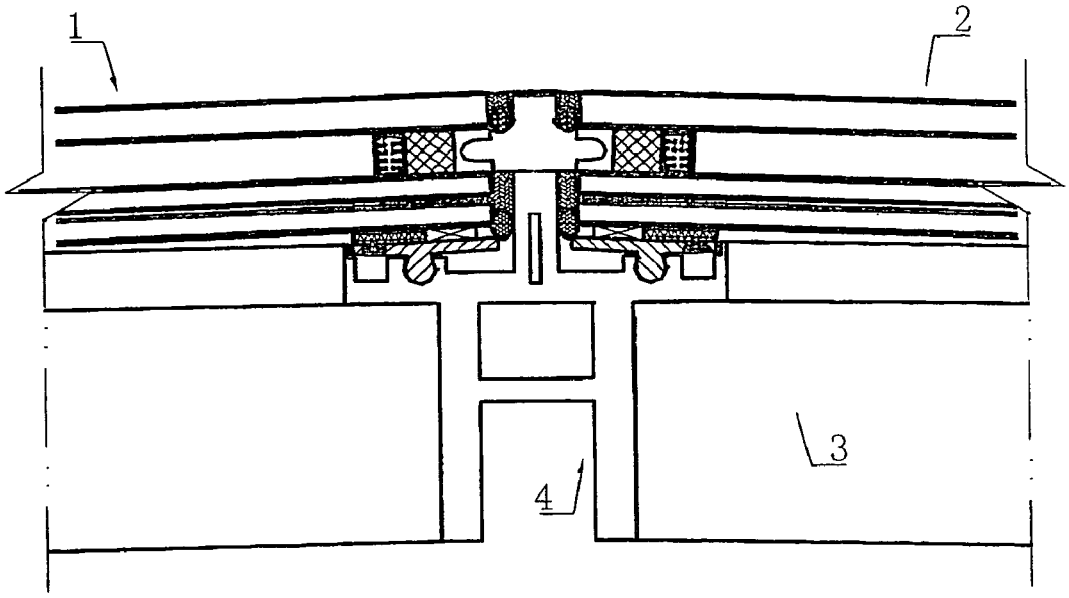
FIG. 10 is a cross-sectional view, not including a pressing block or hooking member adjacent to one edge of a frame made up of beams.
Figure 11:
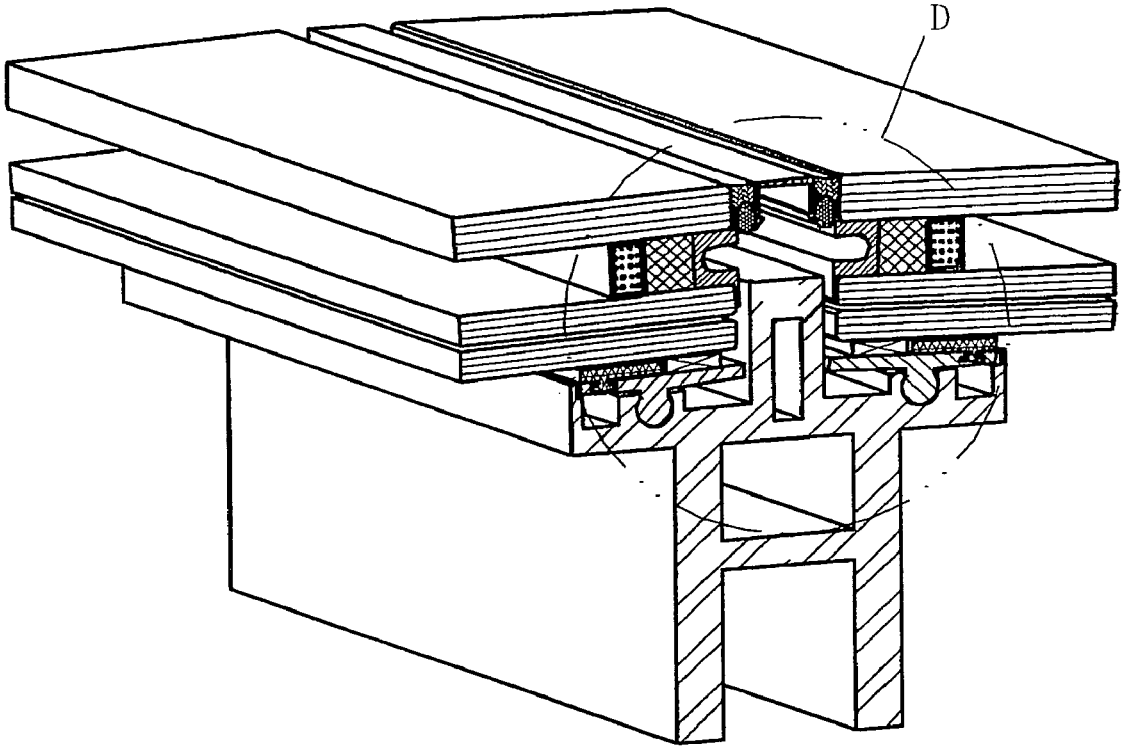
FIG. 11 is a perspective view of the fraction in FIG. 10.
Figure 12:
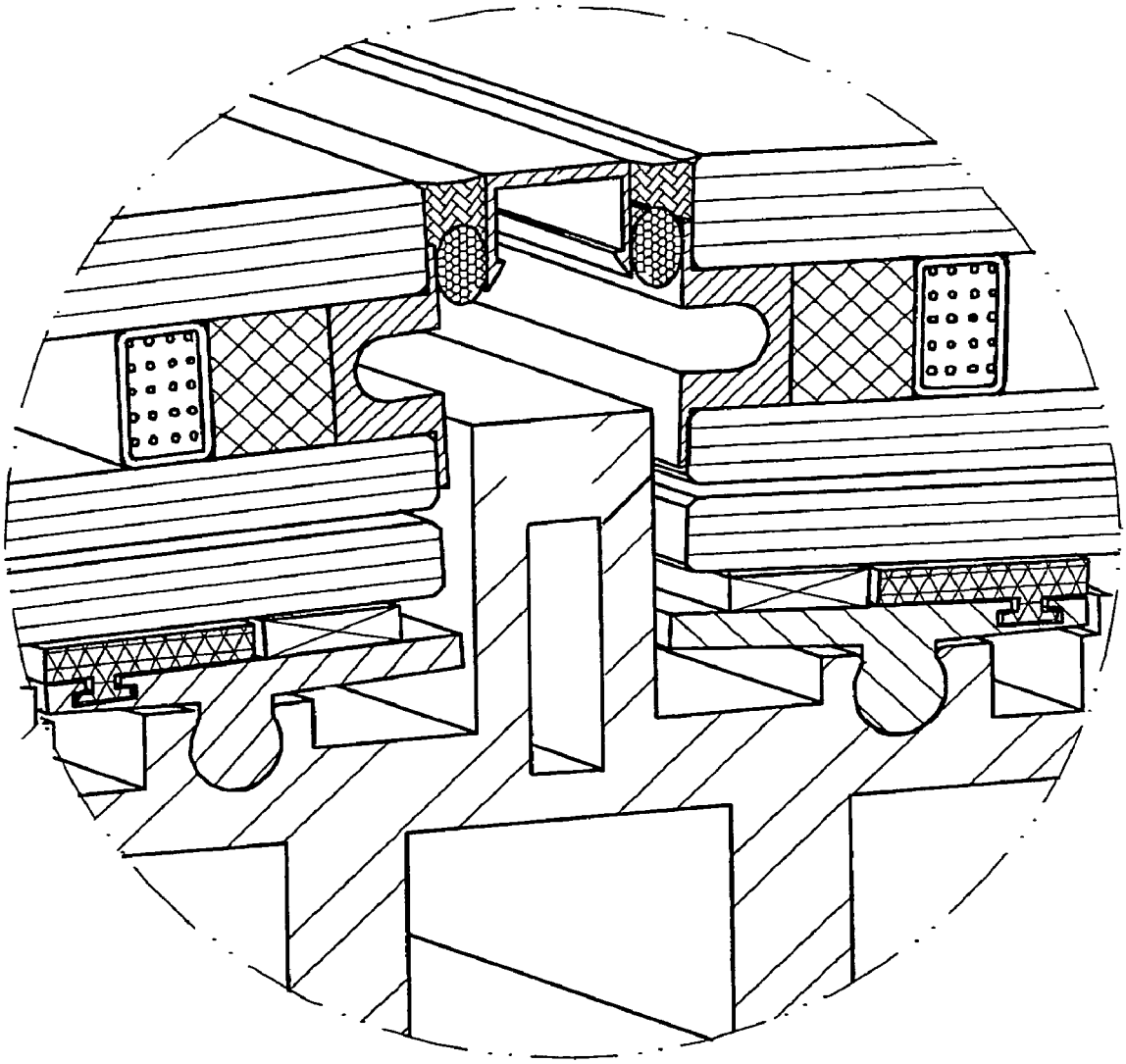
FIG. 12 is an enlarged view of section D in FIG. 11.

Referring to FIG. 10, FIG. 11 and FIG. 12, these drawings are intended to help understand the cross section without the pressing block and the hooking member.

Figure 13:
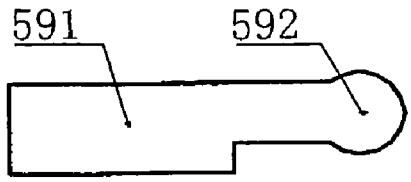
FIG. 13 is a side view showing a single-side pressing block.
Figure 14:
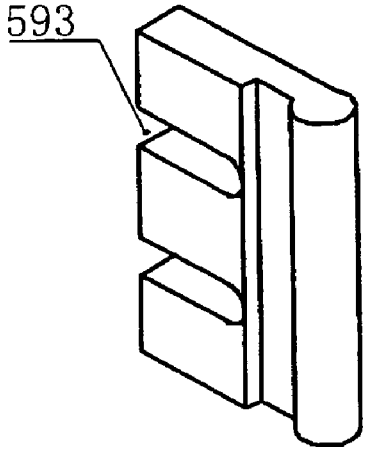
FIG. 14 is a perspective view of a single-side pressing block.

Referring to FIG. 13 and FIG. 14, these two drawings are intended to show the structure of a single-side pressing block 59. The single-side pressing block is a substantially rectangle block body, the size of which in width is smaller than the gap distance between two adjacent glasses. Therefore, it can be moved downright and then placed conveniently into a defined position via that gap. This is an advantage of the single-side pressing block, while a disadvantage is the pressing blocks on the two shoulders must be staggered relative to each other, requiring more fasteners to fix the pressing blocks. The longer edge of every single-side pressing block forms into a pressing head 592. The fixing slots 593 disposed on the main body 591 are used for the fasteners extending through the main body 591.

Figure 15:
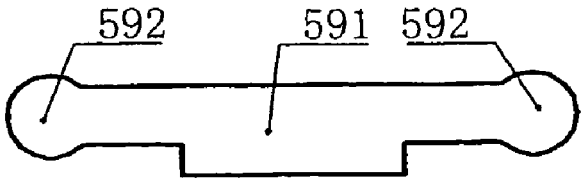
FIG. 15 is a side view showing a double-side pressing block.

According to the design purpose of the present invention, a great variety of alterative structures can be made. For example, the pressing block may be designed into a double-side pressing block, as shown in FIG. 15. For the double-side pressing block, two pressing heads 592 are disposed on both sides of the main body 591 and used to simultaneously fix two hollow gum-sandwiched glasses placed on the left and right shoulders. An elliptical hole extending transversely is provided on the main body 591 for the fastener extending through the main body 591. The advantage of this type of pressing block is the number of fasteners required is reduced. The disadvantage of this type of pressing block is it can only be pushed in from one end of the beams due to its length which is longer than the distance defined by the edges of two adjacent glasses. In some special circumstances, this type of pressing block is less convenient for use than the single-side pressing block.

The invention has been described with reference to the preferred embodiments. Obviously, other embodiments which may include modifications and alterations of the described invention are possible after reading and understanding this present application. This application is intended to include such other embodiments, modifications and alterations.

The invention claimed is:

1. A device for fixing glasses on a curtain wall or roofing, comprising:

a glass supporting beam having a cross section, which has a base portion and shoulders for supporting two adjacent glasses;

a pressing bar having a bar slot and a glass pressing surface which is perpendicular to the surface on which the bar slot is provided;

a pressing block fixed on the base portion of the glass supporting beam having a pressing head extending into the bar slot; and an adjustable block is disposed between each of the shoulders and the glasses; wherein the adjustable block has an upper surface for supporting glass, and a bar hinge head formed on its bottom surface and hinged to a bar hinge base on each of the shoulders.

2. The device for fixing glasses on a curtain wall or roofing according to claim 1, wherein a double-faced adhesive strip and a sealing cushion are pressed between the upper surface and the glass.

3. The device for fixing glasses on a curtain wall or roofing according to claim 2, wherein a hooking member provided on the base portion of the glass supporting beam hooks a pressing cap pressed in the seam between the adjacent glasses.

4. The device for fixing glasses on a curtain wall or roofing according to claim 3, wherein a sealing adhesive strip and a seal gum are disposed between the two sides of the pressing cap and the end surface of the glasses.

5. The device for fixing glasses on a curtain wall or roofing according to claim 3, wherein at least one screw connects the pressing block to the base portion.

6. The device for fixing glasses on a curtain wall or roofing according to claim 5, wherein at least one screw connects the hooking member to the base portion.

7. The device for fixing glasses on a curtain wall or roofing according to claim 1, wherein the hooking member is discontinuously fixed to the base portion.

8. The device for fixing glasses on a curtain wall or roofing according to claim 1, wherein the pressing-block is single-sided.

9. The device for fixing glasses on a curtain wall or roofing according to claim 1, wherein the pressing-block is double-sided.

10. The device for fixing glasses on a curtain wall or roofing according to claim 1, wherein the pressing-block forms fixing slots.

11. A device for fixing glasses on a curtain wall or roofing, comprising:

a supporting beam having a cross section, which has a base portion and shoulders for supporting two adjacent glasses;

a pressing bar having a bar slot and a glass pressing surface which is perpendicular to the surface on which the bar slot is provided;

a pressing block fixed on the base portion of the supporting beam having a pressing head extending into the bar slot;

an adjustable block disposed between each of the shoulders and the glasses; wherein the adjustable block has an upper surface for supporting glass, and a bar hinge head formed on its bottom surface and hinged to a bar hinge base on each of the shoulders; and a hooking member provided on the base portion of the supporting beam that hooks a pressing cap pressed in a seam between adjacent glasses.

12. The device according to claim 11, wherein a double-faced adhesive strip and a sealing cushion are pressed between the upper surface and the glass.

13. The device for fixing glasses on a curtain wall or roofing according to claim 11, wherein a sealing adhesive strip and a seal gum are disposed between the two sides of the pressing cap and the end surface of the glasses.

14. The device for fixing glasses on a curtain wall or roofing according to claim 11, wherein at least one screw connects the pressing block to the base portion.

15. The device for fixing glasses on a curtain wall or roofing according to claim 11, wherein at least one screw connects the hooking member to the base portion.

16. The device for fixing glasses on a curtain wall or roofing according to claim 15, wherein the hooking member is discontinuously fixed to the base portion.

17. The device for fixing glasses on a curtain wall or roofing according to claim 11, wherein the pressing-block is single-sided.

18. The device for fixing glasses on a curtain wall or roofing according to claim 11, wherein the pressing-block is double-sided.

19. The device for fixing glasses on a curtain wall or roofing according to claim 11, wherein the pressing-block forms fixing slots.

20. A device for fixing glasses on a curtain wall or roofing, comprising:

a supporting beam having a cross section, which has a base portion and shoulders for supporting two adjacent glasses;

a pressing bar having a bar slot and a glass pressing surface which is perpendicular to the surface on which the bar slot is provided;

a pressing block fixed on the base portion of the supporting beam having a pressing head extending into the bar slot; and a hooking member provided on the base portion of the supporting beam that hooks a pressing cap pressed in a seam between the adjacent glasses.

* * * * *